US012295436B2

(12) United States Patent
Mastel

(10) Patent No.: US 12,295,436 B2
(45) Date of Patent: May 13, 2025

(54) AMBIDEXTROUS KEYHOLE-ACCESS POCKET

(71) Applicant: Cheryl Mastel, Brookfield, WI (US)

(72) Inventor: Cheryl Mastel, Brookfield, WI (US)

( * ) Notice: Subject to any disclaimer, the term of this patent is extended or adjusted under 35 U.S.C. 154(b) by 0 days.

(21) Appl. No.: 17/969,079

(22) Filed: Oct. 19, 2022

(65) Prior Publication Data

US 2023/0123875 A1 Apr. 20, 2023

Related U.S. Application Data

(60) Provisional application No. 63/262,751, filed on Oct. 20, 2021.

(51) Int. Cl.
*A41D 27/20* (2006.01)
*A41D 23/00* (2006.01)

(52) U.S. Cl.
CPC ..... *A41D 27/20* (2013.01); *A41D 23/00* (2013.01)

(58) Field of Classification Search
CPC ..... A41D 23/00; A41D 27/20
See application file for complete search history.

(56) References Cited

U.S. PATENT DOCUMENTS

| | | | |
|---|---|---|---|
| 2,870,448 | A | 1/1959 | Rosenthal |
| 7,467,423 | B1 | 12/2008 | Tawfik |
| 9,138,021 | B2 | 9/2015 | Mardirosian |
| 9,138,022 | B2 | 9/2015 | Walker |
| 10,912,343 | B1 | 2/2021 | Blaylock |
| 2005/0039242 | A1* | 2/2005 | Edmondson ..... A42B 1/004 2/207 |
| 2007/0033706 | A1 | 2/2007 | Kuhlmann |
| 2012/0042432 | A1 | 2/2012 | Tawfik |
| 2012/0066812 | A1 | 3/2012 | Alzate |
| 2012/0204323 | A1 | 8/2012 | Park |
| 2014/0259334 | A1 | 9/2014 | Mitchell |
| 2017/0079346 | A1 | 3/2017 | Chopra et al. |
| 2017/0135422 | A1 | 5/2017 | Guilfoyle |

(Continued)

FOREIGN PATENT DOCUMENTS

| | | | |
|---|---|---|---|
| CN | 2882300 | Y | 3/2007 |
| CN | 201088160 | Y | 7/2008 |

(Continued)

OTHER PUBLICATIONS

Oxford Languages definition of "flap" (Year: 2024).*
Sprigs, https://sprigs.com/faux-fur-scarf-with-hidden-pocket/.

*Primary Examiner* — Sally Haden
(74) *Attorney, Agent, or Firm* — von Briesen & Roper, s.c.

(57) ABSTRACT

Many garments lack pockets, and/or have pocket openings which may: be accessible to only right hand or left exclusively, require both hands to open the pocket closure, gape open, allowing items to exit the pocket without the wearer intending this. An extra pocket or a plurality of pockets offering both security and easy access is a welcome amenity. Disclosed is the reversible ambidextrous keyhole-access pocket, first embodiment as an integral part of a scarf having one or more such pockets, as well as a new method of suspending and accessing said pocket. Practical and elegantly simple but also unique, novel, surprising and unexpected, the combination of a particular style of keyhole and pocket, transforms the utility and convenience of pockets, improving articles into which said pockets are made.

5 Claims, 7 Drawing Sheets

(56) References Cited

U.S. PATENT DOCUMENTS

| | | | |
|---|---|---|---|
| 2017/0208881 | A1 | 7/2017 | Leathers |
| 2017/0215499 | A1 | 8/2017 | Sobers |
| 2020/0329795 | A1 | 10/2020 | Rhodes |

FOREIGN PATENT DOCUMENTS

| | | | |
|---|---|---|---|
| CN | 202680598 | U | 1/2013 |
| CN | 203087629 | U | 7/2013 |
| CN | 104223501 | A | 12/2014 |
| CN | 204393448 | U | 6/2015 |
| CN | 205082695 | U | 3/2016 |
| CN | 205567936 | U | 9/2016 |
| CN | 206507388 | U | 9/2017 |
| FR | 2534783 | A1 | 4/1984 |
| GB | 848169 | A | 9/1960 |
| KR | 1020100063222 | A | 6/2010 |
| WO | 2021134115 | A1 | 7/2021 |

* cited by examiner

AMBIDEXTROUS KEYHOLE-ACCESS POCKET

CROSS-REFERENCE TO RELATED APPLICATION

This application is a Non-Provisional Patent Application claiming priority under 35 U.S.C § 119 (e) to U.S. Provisional Patent Application Ser. No. 63/262,751 filed on Oct. 20, 2021, the disclosure of which is incorporated herein by reference in its entirety.

FIELD OF THE DISCLOSURE

The present disclosure is generally related of reversible scarfs and other accessories, and further is related to several fields and industries, including the fiber arts, the fabric industry, the yarn industry, and the garment industry.

BACKGROUND OF THE DISCLOSURE

The utility of many garment pockets is limited because they can be accessed by only one hand or the other. Many scarf pockets with closures (snap, zipper, button, hook & loop, magnet, etc.) also require two hands to open. Moreover, many scarf pockets without closures may tend to bag, sag and gape open, becoming unattractive with use, and not hold items securely, but rather leave pocket contents vulnerable to gravity and/or pickpockets.

In addition, most scarves with pockets are not reversible, and their usefulness depends upon being worn with their front (or right side) facing outward, and their back (or wrong side) facing the body. Many scarves with discreet pockets are made for women and are advertised as a woman's accessory. Furthermore, some scarves with pockets incorporate plastic which may be uncomfortable to wear and may not be easily washable or dry-cleanable. The prior art in this field includes US20120042432, U.S. Pat. Nos. 9,138,022, 9,138,021, US20170135422. However, none individually or in any combination disclose the features of the present ambidextrous keyhole-access pocket.

SUMMARY OF THE DISCLOSURE

Ambidextrous keyhole-access pockets are an improvement over existing pockets with closures as items in an ambidextrous keyhole-access pocket may be accessed using only one hand, and this may be either hand.

Items in the pocket remain secured by the passive restraint system provided by the transformational and synergistic combination of a specific style of keyhole adjoined with a specific type of pocket, in a specific manner. Keyhole-access provides passive restraint for items in the adjoining pocket, as items must both rise up above the mouth of the pocket and make a 90-degree turn to exit the pocket through the attached keyhole.

As compared with a typical open pocket on a scarf, the form and function of the ambidextrous keyhole-access pocket deter would-be pickpockets and also reduce the likelihood of items falling out due to gravity.

The ambidextrous keyhole-access pocket is reversible, and its first embodiments are as an integral part of a reversible scarf. Reversible garments and accessories are preferred by people who are blind and/or have low vision, as they can don reversible items confidently and with ease.

Ambidextrous keyhole-access pocket scarves are unisex, and can be advertised as fashionable and practical for both men and women.

The construction of ambidextrous keyhole-access scarves uses soft materials and fibers which may be easily laundered (or depending upon choice of materials, may be dry-cleaned).

These and other aspects and features of the present disclosure will become more readily apparent upon reading the following detailed description and accompanying changes.

DETAILED DESCRIPTION OF THE DISCLOSURE

Figure 1:
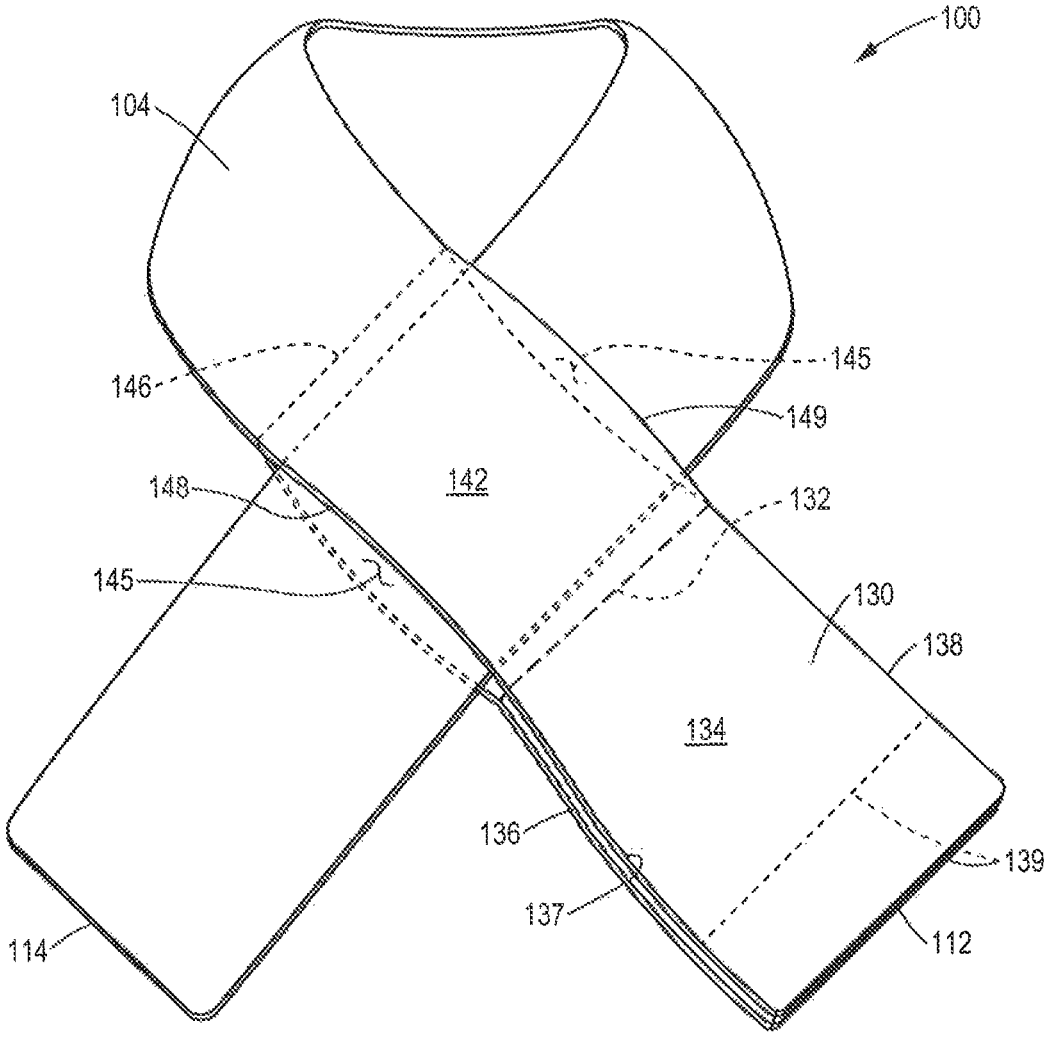
FIG. 1 is a perspective view of a scarf embodiment of the present disclosure in a worn configuration.

Referring to the drawings, and with specific reference to FIG. 1, a scarf constructed in accordance with the present disclosure is generally designated by reference numeral 100. While the first embodiment is referred to and depicted as a scarf, it is to be understood that the teachings of the present disclosure can be used to construct many other items having an ambidextrous keyhole-access pocket including but not limited to shawls, hats, garments, towels, eyeglass cases, purses and the like.

Figure 2:
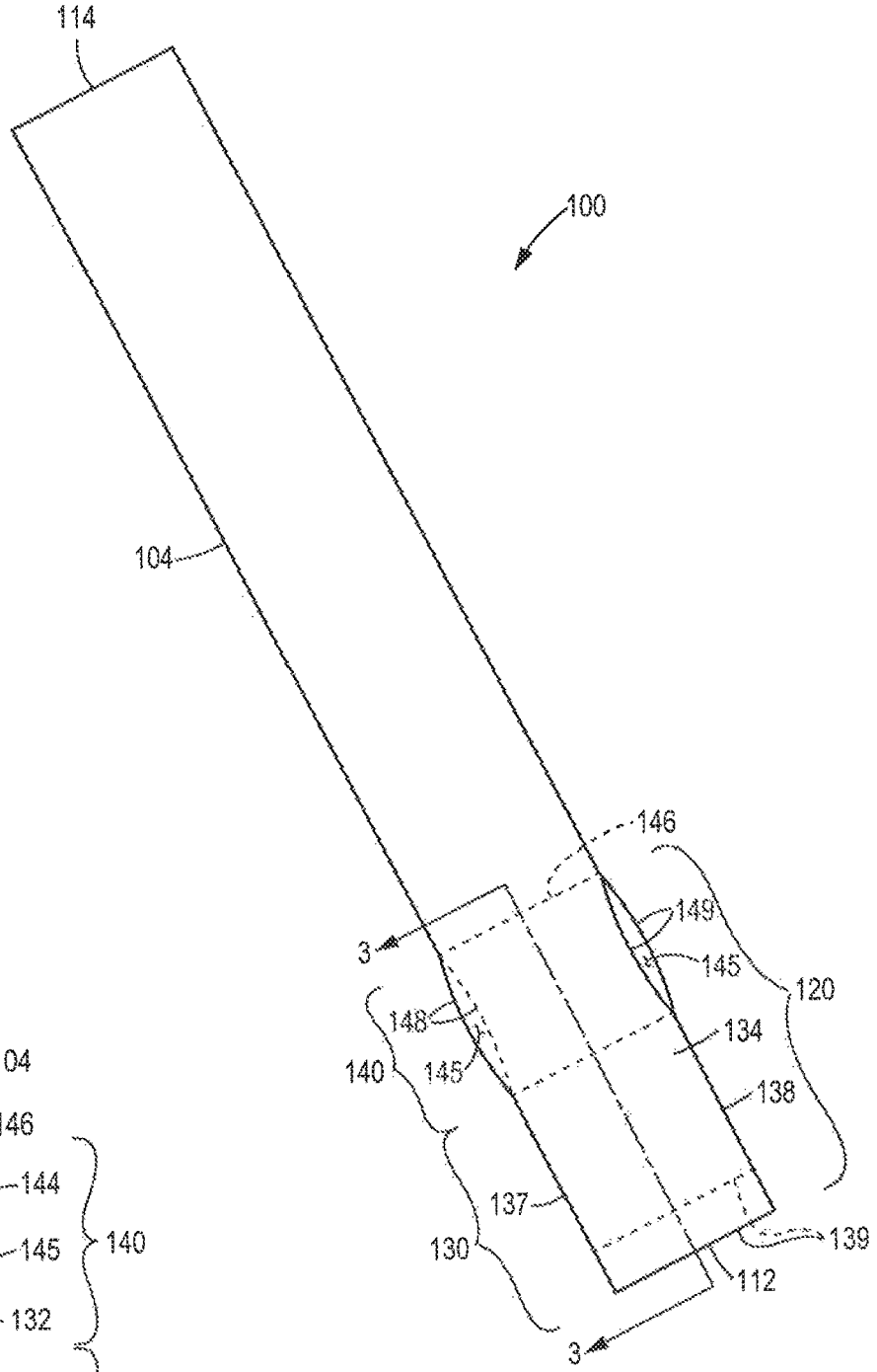
FIG. 2 is plan view of the scarf of FIG. 1 and depicted in an unassembled state.
Figure 3:
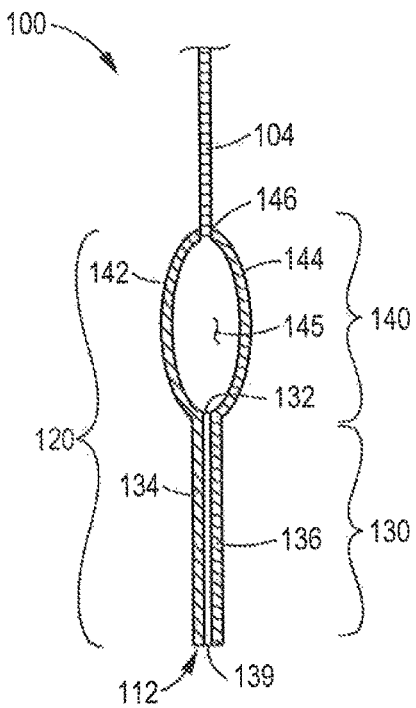
FIG. 3 is a cross-sectional view of FIG. 2 taken along line 3-3 of FIG. 2.

With reference to FIGS. 1-3, the scarf 100 depicts an embodiment of the present disclosure. The scarf is shown to include a length of fabric forming a body 104. The body 104 has a first end 112 and a second end 114. Proximate the first end 112 is an ambidextrous keyhole-access pocket 120 or keyhole-pocket assembly, comprising a pocket 130, with a keyhole structure 140 being provided thereabove. The pocket 130 comprises a first side 134 and second side 136, connected at three edges: the first and second side edges 137, 138, and the lower edge 139. The lower edge 139 of the pocket 130 may coincide with the first end 112 of the scarf embodiment 100, or may be located a distance from the first end 112, with a length of the scarf body 104 between the first end 112 and the lower edge of the pocket 139. The keyhole structure 140 comprises a first side 142 and second side 144, the upper edge of these two sides being connected 146 to each other; the side edges 148, 149 of the keyhole structure being open. The bottom edge of the first side 142 of the keyhole structure 140 is connected to the upper edge of the first side 134 of the pocket 130; the bottom edge of the second side 144 of the keyhole structure 140 is connected to the upper edge of the second side 136 of the pocket 130, thereby forming the pocket opening 132. The keyhole opening 145 is a tunnel-like pass-through sandwiched between the first and second sides 142, 144 of the keyhole structure 140. The width of the keyhole opening 145 extends the width of the keyhole structure's first 142 and second 144 sides, from the first side edge opening 148 to the second side edge opening 149. The height of the keyhole opening matches the height of the first and second sides 142, 144 and the first and second side edge openings 148, 149.

Figure 4:
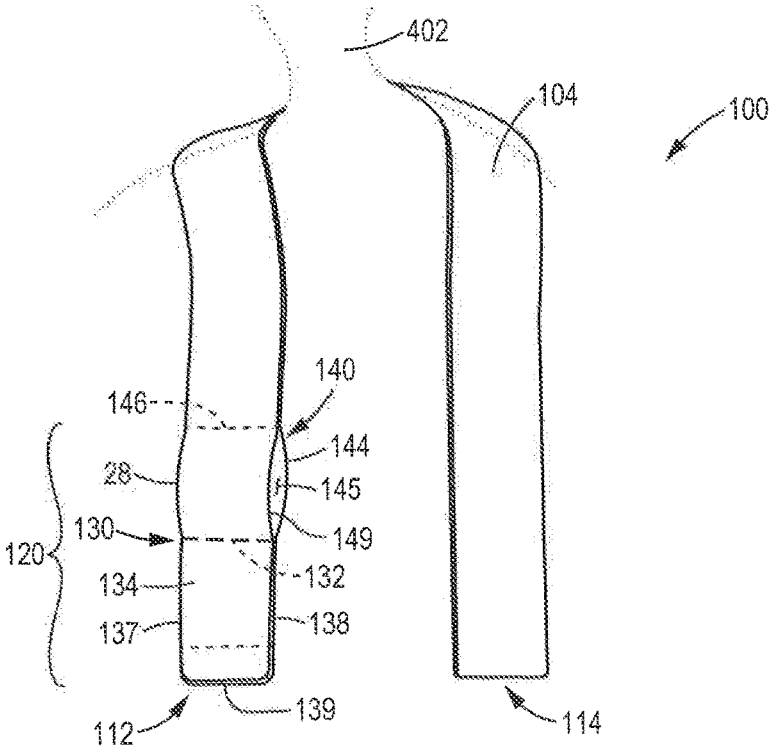
FIG. 4 is a perspective view of the scarf and depicted in an initial position on a representative user.
Figure 5:
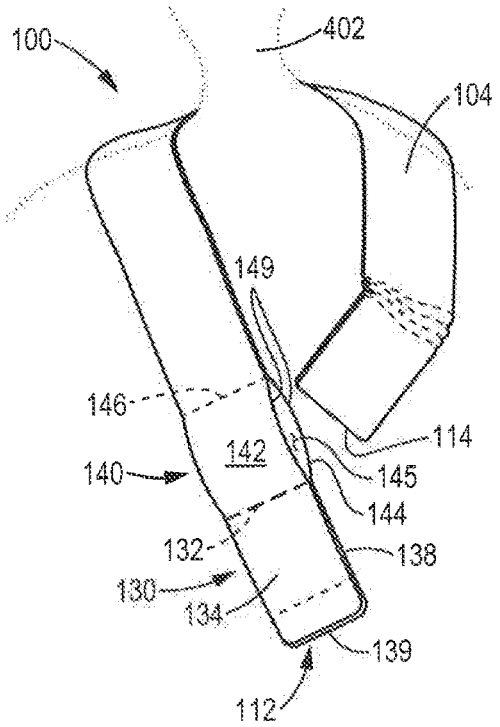
FIG. 5 is a perspective view of the scarf and depicted in an intermediate position.
Figure 6:
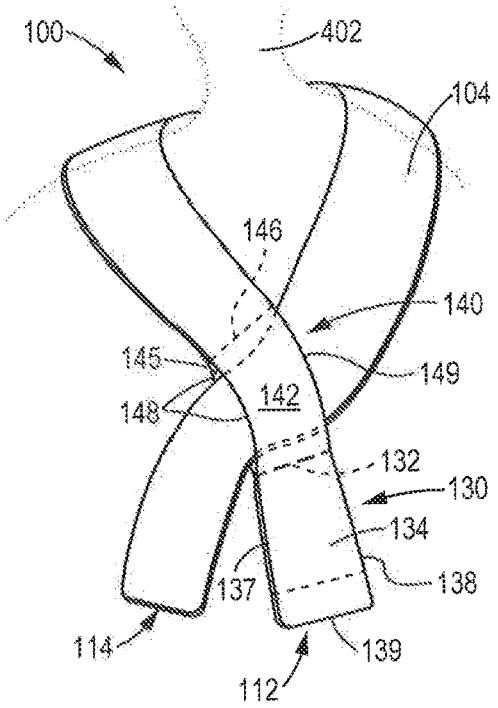
FIG. 6 is a perspective view of the scarf and depicted in a final position.

With reference to FIGS. 4-6, the scarf 100 is depicted in various states of assembly on a user 402. Turning attention to FIG. 4, the body 104 is shown draped around the shoulders of the user 402. As depicted, the first end 112 and second end 114 extend roughly equidistant over the chest of user 402, but this is not essential. As depicted, the first end 112 is on the right hand side of user 402 and the second end 114 is on the left hand side of user 402, however this could be reversed. The configuration depicted in FIG. 4, and its reversal or mirror image, are referred to herein as the initial worn position.

Once the scarf 100 is in the initial worn position, the user inserts the second end 114 through the keyhole opening 145, via keyhole side edge 149, as indicated in FIG. 5. As the keyhole opening 145 can be accessed through either keyhole side edge 148, 149, depending on the handedness of the user, when worn reversed with the first end 112 on the left hand side of the user 402, the second end 114 is inserted through the keyhole opening 145 via keyhole side edge 148. The configuration shown and its reversal or mirror image are the intermediate position.

Upon completing the insertion, the scarf 100 will attain the final worn position shown in FIG. 6. As depicted, the second end 114 is fully extended through the keyhole opening 145 in the worn position. The scarf 100 is secured around the user 402 and the pocket 130 can be accessed through keyhole 145 from either side edge opening 148 or 149 using either hand of the user 402. To do so, the hand of the user 402 is extended first through the keyhole 145 and the into pocket 130 through opening 132.

Although the foregoing embodiment refers to and depicts a scarf with a single ambidextrous keyhole-access pocket 120, it is to be understood that the teachings of this disclosure include other scarf embodiments as well as other apparatus embodying ambidextrous keyhole-access pockets. FIGS. 7-13 are examples of such embodiments but are by no means exhaustive.

Figure 7:
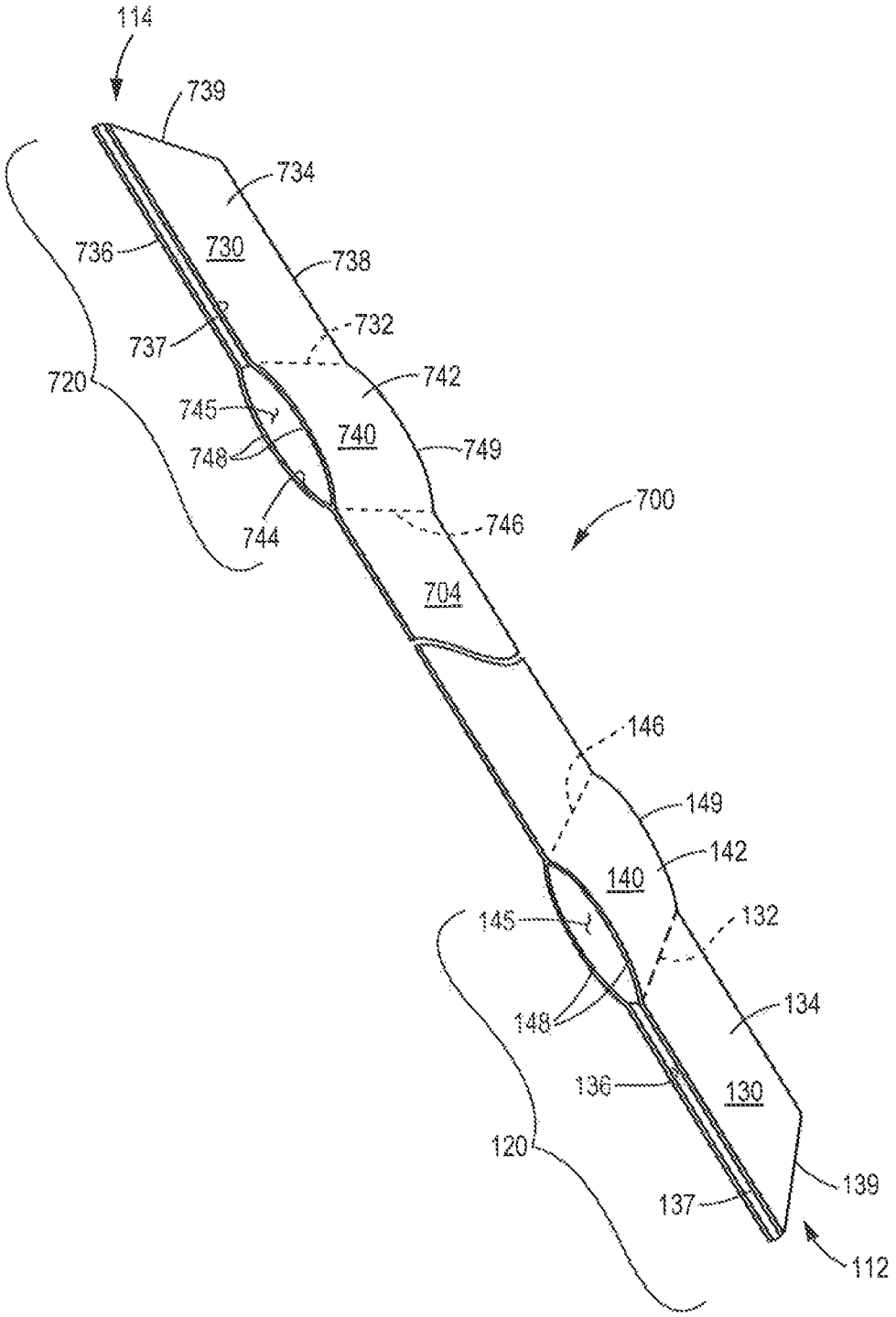
FIG. 7 is a perspective view of an alternative scarf embodiment with multiple pockets.

Referring now to FIG. 7, an alternative scarf 700 is depicted. As will be noted the scarf 700 is similar to scarf 100 in many respects but now includes a second ambidextrous keyhole-access pocket 720 or keyhole-pocket assembly, comprising the second pocket 730 and second keyhole structure 740, in addition to a first ambidextrous keyhole-access pocket 120 comprising the pocket 130 and keyhole structure 140. The second pocket 730 comprises a pocket opening 732, first side 734, second side 736, with the first and second sides connected at the side edges 737, 738 and lower edge 739. The second keyhole structure 740 comprises a first side 742 and second side 744, the upper edge of these two sides being connected 746 to each other; the side edges 748, 749 of the keyhole structure being open; the bottom edge of the first side 742 of the keyhole structure 740 being connected to the upper edge of the first side 734 of the pocket 130; and the bottom edge of the second side 744 of the keyhole structure 740 being connected to the upper edge of the second side 736 of the pocket 730, thereby forming the pocket opening 732. The keyhole opening 745 is a tunnel-like pass-through sandwiched between the first side and second sides 742, 744 of the keyhole structure 740. The width of the keyhole opening 745 extends the width of the keyhole structure first side 742 and second side 744, from the first side edge opening 748 to the second side edge opening 749. The height of the keyhole opening matches the height of the first and second sides 742, 744 and the first and second side edge openings 748, 749. To fasten the scarf and attain the final worn position, either first end 112 can be inserted through second keyhole opening 745 (via side edge opening 748 or 749), or second end 114 can be inserted through first keyhole opening 145 (via side edge opening 148 or 149). Other embodiments could include even more pockets and keyholes.

Figure 8:
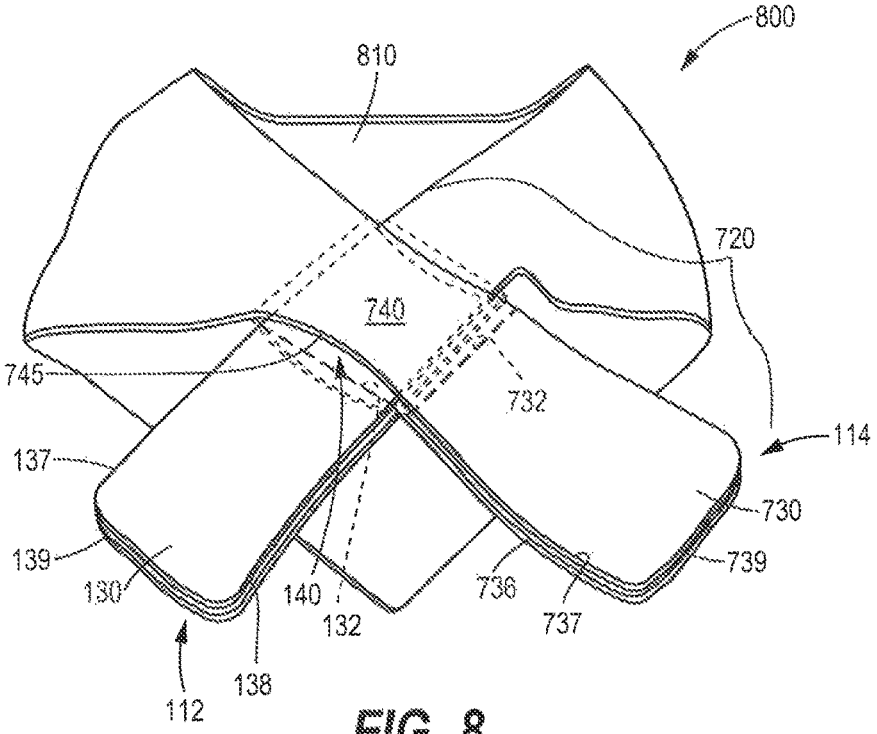
FIG. 8 is a perspective view of a shawl embodiment.

Aside from scarves, many other items can be constructed with ambidextrous keyhole-access pockets. For example, FIG. 8 depicts a shawl 800 embodiment. The shawl 800 is largely the same as the scarf 700 but includes a broadened back panel 810 to cover the back of a user (not shown). First and second keyhole-pocket assemblies 120, 720 are provided, comprising first and second pockets 130 and 730, and first and second keyholes 140 and 740.

Figure 9:
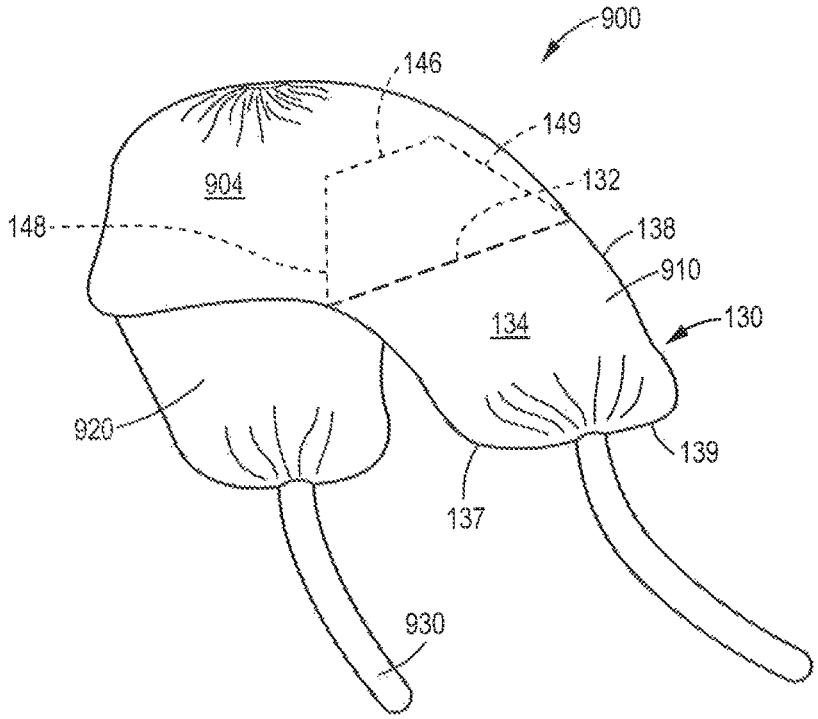
FIG. 9 is a perspective view of a hat embodiment.

As seen in FIG. 9, a hat 900 can also be constructed using the teachings of the present invention with first and/or second ear flaps, 910 and 920, respectively, each being formed by an ambidextrous keyhole-pocket assemblies 120 and 720. An optional strap 930 is a decorative element extending from the lower edge of the ear flap.

Figure 10:
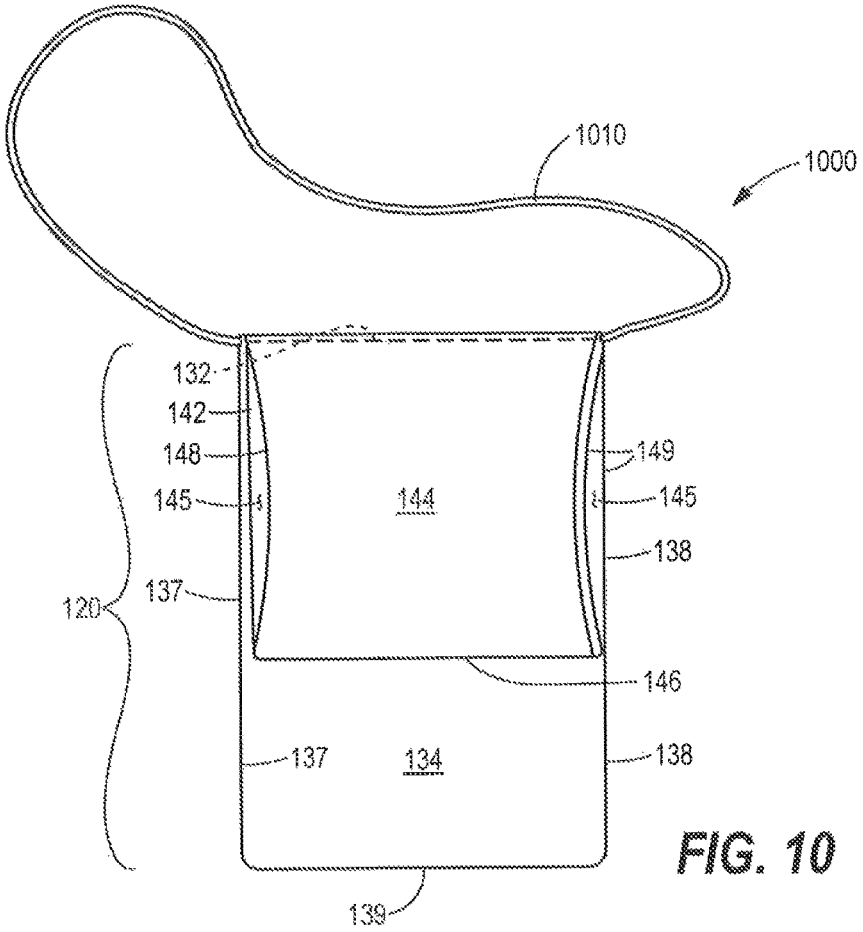
FIG. 10 is a perspective view of a purse embodiment.

FIG. 10 depicts a purse embodiment. As shown, the purse 1000 comprises an ambidextrous keyhole-access pocket 120 and a conventional strap 1010. The strap 1010 is connected where the pocket opening 132 meets the pocket side edges 137, 138. Gravity allows the keyhole structure 140 to fold over the pocket 130.

Figure 11:
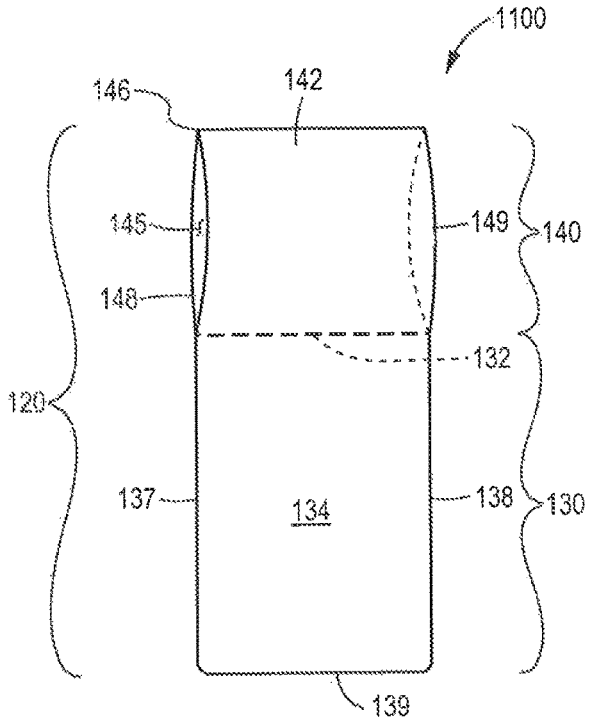
FIG. 11 is a perspective view of an eyeglasses case embodiment.

Similarly, the teaching of this disclosure can be used to construct a storage case such as the eyeglasses case 1100 depicted at FIG. 11. The eyeglass case 1100 comprises an ambidextrous keyhole-access pocket 120, comprising a pocket 130, and a keyhole structure 140, with all their aforementioned components and features. Storage cases for items other than eyeglasses are certainly possible.

Figure 12:
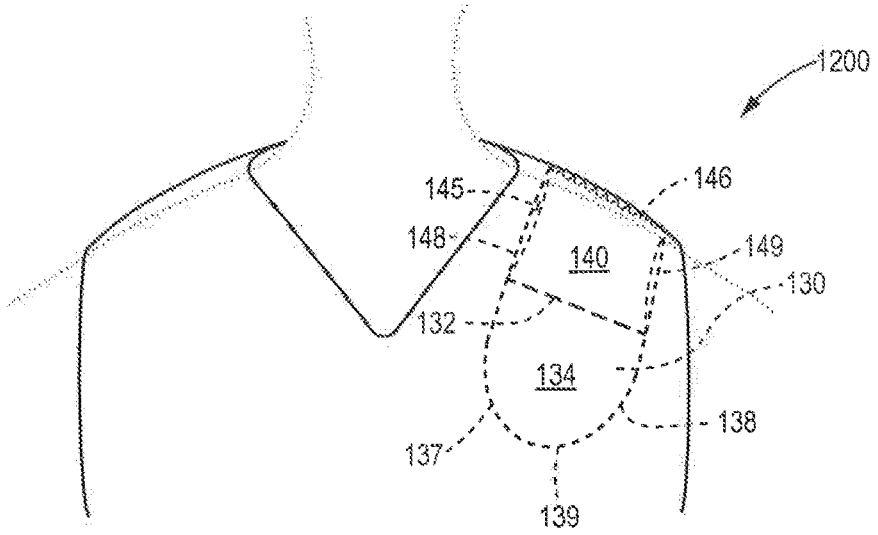
FIG. 12 is a perspective view of an ambidextrous keyhole-access pocket attached to an inner shoulder seam of a garment (such as a shirt or blouse, vest, jacket, or coat).
Figure 13:
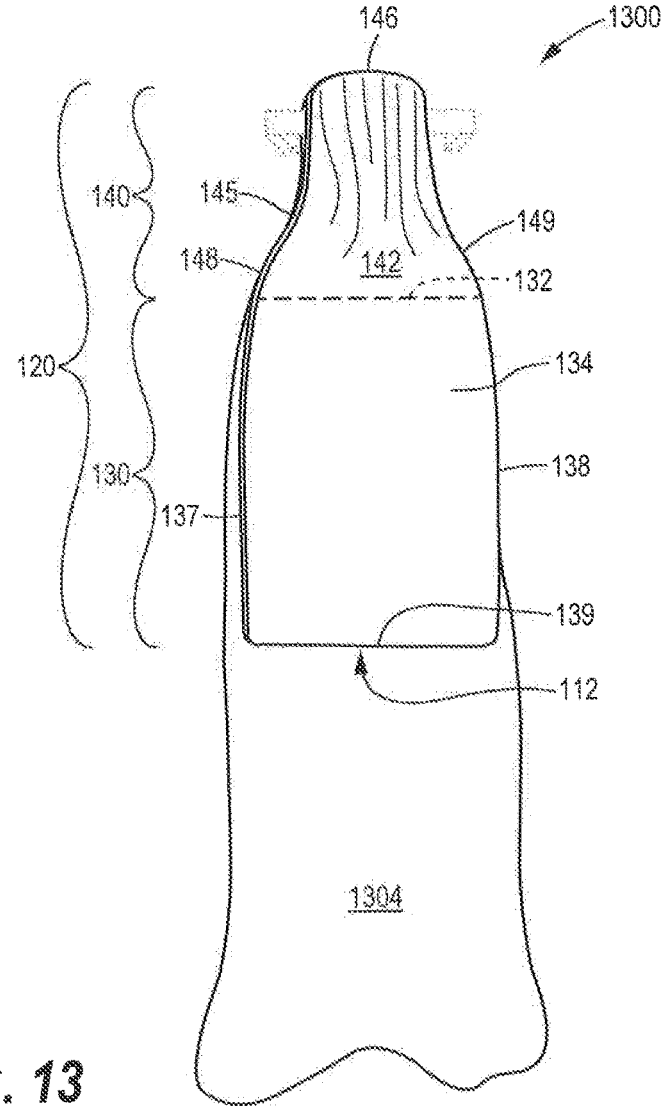
FIG. 13 is a perspective view of a towel embodiment.

Similarly, in FIGS. 12 and 13 a garment 1200 and a towel 1300 are each depicted with an ambidextrous keyhole-access pocket 120, formed therein. The garment embodiment 1200 has a keyhole-pocket assembly 120 attached to an internal shoulder seam of the garment at the upper edge 146 of the keyhole 140 where the first and second sides 142, 144 (not shown) of the keyhole 140 are connected 146 to each other. The towel embodiment 1300 has a body 1304 attached to the upper edge 146 of the keyhole 140 where the first and second sides 142, 144 (not shown) of the keyhole 140 are connected 146 to each other.

Scarf Embodiment Details

The first embodiments of the ambidextrous keyhole-access pockets are adjustable, reversible unisex neckwarmer scarves or mufflers with reversible ambidextrous keyhole-access pockets. When worn open, a minimalist, streamlined unisex scarf with one or more ambidextrous keyhole-access pockets appears at first glance to be a plain ordinary straight scarf, with a fairly uniform width.

The placement of the ambidextrous keyhole-access pocket(s) in a scarf embodiment may be at the lower edge of the scarf end(s) or at a distance up from the end(s) of the scarf, with optional scarf body below the pocket(s).

The location of the ambidextrous keyhole-access pocket(s) in a scarf embodiment, relative to the wearer's body, may be considered chest/breast pockets and/or waist/hip pockets. This may vary depending upon the size of the scarf and how the scarf is worn. See "States of the scarf embodiment."

The noticeability of the ambidextrous keyhole-access pocket(s) may be attention-getting or concealed/discreet and these differences may be accomplished using any combination of materials, surface textures, colors, and construction methods which may highlight or obscure the perception of scarf thickness and/or the various components of the embodiment, keyhole, and pocket. Ambidextrous keyhole-access pockets are versatile: the pocket can be secret, hidden in plain view, nearly unnoticeable—OR—can be a conversation piece and featured focal point of the embodiment. Some examples to leverage the utility of ambidextrous keyhole-access pockets for a wide variety of uses: smooth or textured materials (such as fur, polar fleece; fuzzy, eyelash, or roving yarn(s); and light or heavyweight fabric(s)), solid or patterned materials (such as tweed or printed yarn(s); tweed or houndstooth fabric(s), color combinations (such as solid, stripes, prints, ombre, school colors, flag colors, or team colors), construction methods (same or varied throughout the scarf, highlighting or obscuring the keyhole(s) and pocket(s)).

The utility of the ambidextrous keyhole-access pocket and the articles into which it is incorporated may be enhanced by creating each article with or without embellishment, adornment, surface decoration and/or ornamentation, including but not limited to: lightweight fabrics for warm seasons or warm weather climates, additional width of the scarf body providing the wearer with extra coverage and warmth in cold weather, shaped pockets, shaped keyholes, shaped scarves, knit and/or crochet stitch textures, including basket weave, checkerboard, Aran, Irish, cables, eyelet, granny square, and/or lace, intarsia or colorwork, Nordic and/or Fair Isle, quilting, nature themes including animal faces and/or bodies, seasonal themes, motifs, numbers, symbols, letters, initials, monograms, embroidery, beads, high visibility colors such as neon bright and/or light reflective materials, monochromatic or contrasting color-blocking and/or stripes of various widths, school colors, flag colors, team colors, or any other.

The size of the ambidextrous keyhole-access pocket and the articles into which it is incorporated may be any size. Whether someone is petite or tall, slim or zaftig, an ambidextrous keyhole-access scarf may be right-sized for them.

A minimalist scarf may have a width of approximately 4-6 inches, length approximately 3-4 feet, and neck wrap approximately 16-24 inches for an adult.

When constructed by knitting, the scarf embodiment may be scaled up by using larger yarn and needles, casting on more stitches for a wider scarf, knitting additional rows for more length, and/or adding more ambidextrous keyhole-access pockets.

When constructed by knitting, a scarf embodiment may be scaled down by using smaller yarn and needles, casting on fewer stitches for a narrow scarf, knitting fewer rows for a shorter scarf, and/or creating a scarf with just one ambidextrous keyhole-access pocket. Tiny ambidextrous keyhole-access pocket scarves, sized for a doll or Teddy Bear, have also been made.

States of the Scarf Embodiment

The scarf may be worn open (FIG. 4) with the center of the length of the scarf substantially near the center back of the wearer's neck, and the length of each half of the scarf draped forward over the corresponding shoulder and hanging in front of the wearer. When worn open, the minimalist, streamlined unisex scarf with one ambidextrous keyhole access pocket appears at first glance to be a plain ordinary straight scarf, with a fairly uniform width.

The scarf may be worn closed (FIG. 6) with the center of the length of the scarf substantially near the center back of the wearer's neck, and the length of each half of the scarf draped forward over the corresponding shoulder and one end of the scarf crossing in front of the wearer and tucked through the keyhole, with the length adjusted to fit comfortably on the wearer.

The scarf may be worn wrapped around the neck, fully encircling the neck, and open or closed in front. (Not pictured.)

A scarf embodiment with one ambidextrous keyhole-access pocket and ending in a second keyhole (not pictured) would generally be worn closed, with the ambidextrous keyhole-access pocket passing through the second keyhole and the two keyholes aligned, one inside the other.

Glossary of Terms

Ambidextrous—equally accessible to either hand, with the choice of hand used depending upon the handedness of the user.

Ambidextrous keyhole-access pocket—the present disclosure. An apparatus comprising a specific type of keyhole adjoined with a specific type of pocket, in a specific manner, as revealed. Keyhole-pocket assembly.

Back—the second side, or "wrong side" (WS). In a reversible article or embodiment, the designation may be arbitrary, but serves to indicate there is more than one side.

Bottom—lower edge. Orientation is relative to usual position for utilizing or wearing apparatus or embodiment, regardless of the direction of the item as illustrated on any page of drawings in this application.

Closed—state of scarf or shawl embodiment being worn encircling the neck or around the back of the neck and draped over the shoulders and secured in front of the wearer by means of scarf or shawl end inserted through keyhole. Also described as the final worn position.

Final worn position—state of scarf or shawl embodiment being worn encircling the neck or around the back of the neck and draped over the shoulders and secured in front of the wearer by means of scarf or shawl end inserted through keyhole. Also described as "closed."

Front—the first side, or "right side" (RS). In a reversible article or embodiment, the designation may be arbitrary, but serves to indicate there is more than one side.

Initial worn position—state of scarf or shawl embodiment being worn encircling the neck or around the back of the neck and draped over the shoulders with the ends substantially in front of the wearer's chest. Scarf or shawl end is not inserted through keyhole. Also described as "open."

Items—objects deposited or placed in a pocket, stored, carried, held in the pocket, or removed from the pocket. The term "items" may also refer to articles embodying ambidextrous keyhole-access pockets.

Keyhole—the hole or opening or pass-through used to fasten the scarf or shawl, and/or to access the pocket. See "Keyhole opening." The term "keyhole" may also refer to the structure comprising components which together form the described hole or opening; the keyhole structure. See "Keyhole structure."

Keyhole first side or front side—one of two faces, walls, or flaps between which the keyhole opening is sandwiched. In a reversible article or embodiment, the designations "front" and "back" may be arbitrary, therefore the terms first and second may be used. A component of the Keyhole structure.

Keyhole first side edge opening—one of two slits, ports, portals, which are access points to the keyhole opening. In a reversible article or embodiment, the designation "left" and "right" may be arbitrary, therefore the terms first and second may be used.

Keyhole opening—the hole or tunnel-like pass-through used to fasten the scarf or shawl, and/or to access the pocket (to place items in the pocket, and to retrieve items from the pocket). The keyhole opening is an interior space having substantially fixed characteristics of height and width, while the depth varies during use. The height of the keyhole opening is the height of the keyhole first side, keyhole second side, keyhole first side edge opening, keyhole second side edge opening. The width of the keyhole opening extends from the keyhole first side edge opening to the keyhole second side edge opening, and is the width of the keyhole first side or the keyhole second side.

Keyhole-pocket assembly—the ambidextrous keyhole-access pocket disclosed herein. An apparatus comprising a specific type of keyhole adjoined with a specific type of pocket, in a specific manner, as described.

Keyhole second side or back side—one of two faces, walls, or flaps between which the keyhole opening is sandwiched. In a reversible article or embodiment, the designations "front" and "back" may be arbitrary, therefore the terms first and second may be used. A component of the Keyhole structure.

Keyhole second side edge opening—one of two slits, ports, portals, which are access points to the keyhole opening. In a reversible article or embodiment, the designation "left" and "right" may be arbitrary, therefore the terms first and second may be used.

Keyhole structure—comprising a first side or front side, second side or back side, the connection of these two sides at their upper edge, and having left and right side edge openings, and an open bottom synonymous with the opening at the top of the pocket. Together, these components form, surround, and define an interior space which is the keyhole opening.

Keyhole top edge seam—designates the line at which the first side of the keyhole meets the second side of the keyhole along the upper edge shared in common, whether there is a traditional seam present or not. The top edge seam of the keyhole may be attached to a scarf, shawl, hat, garment, towel, or other embodiment or it may not be attached to anything (eyeglasses case and purse are examples of this).

Mirror image—illustration flipped or rotated to reverse right and left, as though seen reflected in a looking glass or mirror. In a reversible article or embodiment, this serves to indicate that left and right are interchangeable.

Mouth of pocket—opening at top of pocket. Upper edge of pocket. Pocket opening.

Neckwrap—a length of the body of a scarf embodiment, which is intended to encircle a wearer's neck or cover the back of a wearer's neck. For example: in a scarf with two ambidextrous keyhole-access pockets, the neck wrap is the center distance between the two keyholes.

Open—state of scarf or shawl embodiment being worn encircling the neck or around the back of the neck and draped over the shoulders with the ends substantially in front of the wearer's chest. Scarf or shawl end is not inserted through keyhole. Also described as the initial worn position.

Pocket—the interior space which may hold, carry, cradle, or store items. The term "pocket" may also refer to the structure or components forming the described interior space.

Pocket bottom or pocket bottom edge seam—designates the line at which the first side of the pocket is connected or joined with the second side of the pocket along the lower edge shared in common, whether there is a traditional seam present or not. The pocket bottom may be located at the end of an embodiment, or located some length above the end of the embodiment.

Pocket first side or front side—one of two faces or walls, between which the pocket interior space is sandwiched. In a reversible article or embodiment, the designations "front" and "back" may be arbitrary, therefore the terms first and second may be used.

Pocket first side edge seam—designates the line at which the first side of the pocket meets the second side of the pocket along a right or left vertical edge shared in common, whether there is a traditional seam present or not. In a reversible article or embodiment, the designations "left" and "right" may be arbitrary, therefore the terms first and second may be used.

Pocket opening—the top or upper edge of the pocket, connected to and synonymous with the bottom of the keyhole.

Pocket second side or back side—one of two faces or walls, between which the pocket interior space is sandwiched. In a reversible article or embodiment, the designations "front" and "back" may be arbitrary, therefore the terms first and second may be used.

Pocket second side edge seam—designates the line at which the first side of the pocket meets the second side of the pocket along a right or left vertical edge shared in common, whether there is a traditional seam present or not. In a reversible article or embodiment, the designations "left" and "right" may be arbitrary, therefore the terms first and second may be used.

Right Side—(RS), the first side or front side, as opposed to the Wrong Side (WS), second side, or back side. The "right side" edge may also be opposite the "left side" edge. In a reversible article or embodiment, the designation may be arbitrary, but serves to indicate there is more than one side.

Seam—a connection or joining, regardless of whether a traditional fiber arts seam is present.

Side—a face or wall or flap component lying substantially in a plane. The term "side" may also refer to front/back. The term "side" may also refer to an edge on the right or left. In a reversible article or embodiment, the designations "front" and "back" and "left" and "right" may be arbitrary, therefore the terms first and second may be used, i.e. "first side," "first side edge," "second side," "second side edge."

Tail—part of a scarf body, particularly the area proximate an end of a scarf. The term "tail" may refer to the second end of a scarf, opposite the keyhole-pocket assembly. The term "tail" may refer to either end of a scarf.

Top—upper edge. Orientation is relative to usual position for utilizing or wearing apparatus or embodiment, regardless of the direction of the item as illustrated on any page of drawings in this application.

Tuck—to insert the end of a scarf or shawl embodiment into and through the keyhole. The term "tuck" can also refer to a portion of the scarf or shawl body which is inside the keyhole when the scarf or shawl is worn in a closed state.

User—person utilizing, wearing, or interacting with the described article or embodiment.

Wearer—person using or wearing the described article or embodiment; user.

Wrong Side—(WS), the second side or back side, as opposed to the Right Side (RS), first side, or front side. In a reversible article or embodiment, the designation may be arbitrary, but serves to indicate there is more than one side.

Need for the Invention

The utility of many pockets is limited because they can be accessed by only one hand or the other.

Many pockets with closures (snap, zipper, button, hook & loop, magnet, etc.) require two hands to open.

Many pockets without closures may tend to bag, sag and gape open, becoming unattractive with use, and not holding items securely, but rather leaving pocket contents vulnerable to gravity and/or pickpockets.

Most scarves with pockets are not reversible, and their usefulness depends upon being worn with their front (or right side) facing outward, and their back (or wrong side) facing the body.

Many scarves with discreet pockets are made for women and are advertised as a woman's accessory.

Some scarves with pockets incorporate plastic which may be uncomfortable to wear and may not be easily washable or dry-cleanable.

Needs Met by the Invention

Ambidextrous keyhole-access pockets are an improvement over existing pockets with closures as items in an ambidextrous keyhole-access pocket may be accessed with one hand, and this may be either hand.

Items in the pocket remain secured by the passive restraint system provided by the transformational and synergistic combination of a specific style of keyhole adjoined with a specific type of pocket, in a specific manner. Keyhole-access provides passive restraint for items in the adjoining pocket, as items must both rise up above the mouth of the pocket and make a 90-degree turn to exit the pocket through the attached keyhole.

As compared with a typical open pocket on a scarf, the form and function of the ambidextrous keyhole-access pocket deter would-be pickpockets and also reduce the likelihood of items falling out due to gravity.

The ambidextrous keyhole-access pocket is reversible, and its first embodiments are as an integral part of reversible scarves. I'm told that such reversible garments and accessories are preferred by people who are blind and/or have low vision, as they can don reversible items confidently and with ease.

Ambidextrous keyhole-access pocket scarves are unisex, and can be advertised as fashionable and practical for both men and women.

The construction of ambidextrous keyhole-access scarves uses soft materials and fibers which may be easily laundered (or depending upon choice of materials, may be dry-cleaned).

The ambidextrous keyhole-access pocket scarf may be any size. Whether someone is petite or tall, slim or zaftig, an ambidextrous keyhole-access scarf may be right-sized for them.

Description of Methods

Method of Use:

The use of the ambidextrous keyhole-access pocket, embodied in a scarf has a similarity to any other keyhole scarf: just pass the tail end of the scarf through the keyhole to fasten the scarf securely in place. But, unlike any other keyhole scarf known, a user can reach into the keyhole to access the integral pocket.

The wearer may access the contents of their ambidextrous keyhole-access pocket(s), through either side edge opening of the keyhole, whether the scarf is worn open or closed.

Reversible garments and accessories may be preferred by people who are blind and/or have low vision, as they can don reversible items confidently and with ease.

Whether a person may be facing a weather-related emergency, going about everyday activities such as walking the dog or running errands, or attending a fundraising gala and wanting to have tip money readily available for the valet parking attendant, an extra pocket or a plurality of pockets offering both security and easy access is a welcome amenity. Depending upon the adventure you are embarking on, the reversible, ambidextrous keyhole-access pocket will carry your small, lightweight essentials such as lip balm, travel size sunscreen, a small pack of facial tissues, ID, credit card, chewing gum, flash drive, grocery store list, money, business cards, or sunglasses, etc.

The scarf or other embodiment may be used as gift-wrapping, to give a small greeting or gift placed in one or more of its ambidextrous keyhole-access pockets.

Items are held, carried, and stored discreetly provided that the ambidextrous keyhole-access pocket is not overstuffed.

To prevent stretching or creasing, the scarf embodiment can be jelly rolled for storage.

Construction Methods

The ambidextrous keyhole-access pocket and the articles into which it is incorporated may be created by hand or machine knitting, sewing, crochet, macrame, weaving, quilting, or any combination of fiber arts.

The ambidextrous keyhole-access pocket scarf embodiment may be any size. While the first embodiment was created by knitting, and sizing is described in terms of knitting in the majority of this document, the principle of flexible sizing also applies to other methods of construction, such as sewing for example.

The minimalist, hand-knit version of the reversible scarf with one reversible ambidextrous keyhole-access pocket can be created in one piece without seams, working from end to end, up one side and down the other. Pockets are knit in the round using Magic Loop method on circular needles (or using a double knitting technique if you prefer), while the rest of the scarf, including the keyholes, are knit flat. When knitting, this scarf begins with casting on the closed bottom of the pocket and working upward in the round, like a toe-up sock. Above the pocket is the keyhole. Continuing upward is the body of the scarf, which may be any length desired. When creating a plurality of pockets, or in deference to maker preference, construction method may alternate from bottom-up to top-down pocket construction.

The shape of the keyhole(s) may be square, rectangular, or shaped by various means such as cinching, or short rows. (See FIG. 9 which is illustrative not exhaustive) method may alternate from bottom-up to top-down pocket construction.

Each side or flap or face of the keyhole may be constructed from a single piece or from multiple components such as: layering various shapes, positioning individual linear components horizontally and/or vertically and/or diagonally to form each flap of the keyhole. The keyhole flaps may be identical to each other or dissimilar thereby one embodiment may provide multiple "looks." The keyhole(s) and/or individual keyhole flap(s) may be lined or unlined.

The characteristics and shape of the ambidextrous keyhole-access pocket(s) may vary, adapting the form and function to carry, cradle, and hold different items. (See FIGS. 9, 12 which are illustrative, not exhaustive.) The characteristics of the pockets, may be any combination of: lined or unlined; divided or single compartment; shapes such as: semi-circle, oval, square, with corners being angular or rounded off; rectangular, with corners being angular or rounded off; triangular, (wider mouth tapered to point bottom—or—narrow mouth flared to wider bottom) with corners being angular or rounded off; novelty shapes such as socks, stockings, mittens, puppets.

LIST OF REFERENCE NUMERALS

100—scarf embodiment
104—body of scarf embodiment
112—first end of scarf embodiment
114—second end of scarf embodiment
120—ambidextrous keyhole-access pocket; keyhole-pocket assembly. Comprising 130 and 140.
130—pocket. Comprising 132, 134, 136, 137, 138, 139.
132—pocket opening
134—pocket first side
136—pocket second side
137—pocket first side edge seam
138—pocket second side edge seam
139—pocket bottom edge seam
140—keyhole assembly. Comprising 142, 144, 145, 146, 148, 149.
142—keyhole first side
144—keyhole second side
145—keyhole opening or pass-through
146—seam, join, or connection at upper edge of 142 & 144
148—keyhole first side edge opening
149—keyhole second side edge opening
402—user or wearer of embodiment
700—scarf embodiment having multiple pockets
704—body of scarf embodiment having multiple pockets
720—second ambidextrous keyhole-access pocket; keyhole-pocket assembly. Comprising 730 and 740.
730—second pocket. Comprising 732, 734, 736, 737, 738, 739.
732—opening of second pocket
734—first side of second pocket
736—second side of second pocket
737—first side edge seam of second pocket
738—second side edge seam of second pocket
739—bottom edge seam of second pocket
740—second keyhole assembly. Comprising 742, 744, 745, 746, 748, 749.
742—first side of second keyhole
744—second side of second keyhole
745—opening or pass-through of second keyhole
746—seam, join, or connection at upper edge of 742 & 744
748—first side edge opening of second keyhole
749—second side edge opening of second keyhole
800—shawl embodiment
804—body of shawl embodiment
810—broadened back panel
900—hat embodiment
910—first ear flap. Comprising 120.
920—second ear flap. Comprising 720.
930—optional decorative element of ear flap
1000—purse embodiment
1010—purse strap
1100—storage case embodiment; eyeglasses case embodiment
1200—garment embodiment
1204—body of garment embodiment
1300—towel embodiment
1304—body of towel embodiment

The invention claimed is:

1. A scarf, comprising:

a length of fabric having first and second ends, the length of fabric defining a longitudinal axis;

a pocket provided proximate the first end, the pocket including front and back sides closed along left, right and bottom edges, the pocket including an opening along a top edge of the pocket with the top edge being perpendicular to the longitudinal axis of the scarf;

a keyhole provided immediately above the pocket, the keyhole being defined by front and back flaps connected along a keyhole top edge, the keyhole top edge being parallel to the pocket top edge, the front and back flap being open along left and right edges defining a keyhole opening, the bottom of the keyhole flaps being connected to and synonymous with the pocket top edge, forming the pocket opening, the second end of the scarf being adapted to be inserted through one of the keyhole opening left and right edges and out the other of the keyhole opening left and right edges, and the pocket being adapted to be accessed through the keyhole opening and pocket opening, the keyhole opening being large enough to allow a hand of a user to pass through, the keyhole and pocket forming one contiguous open space.

2. The scarf of claim 1, wherein the pocket can be accessed using only one hand of a user.

3. The scarf of claim 1, wherein the pocket can be accessed by either hand of the user.

4. The scarf of claim 1, wherein the scarf is reversible.

5. The scarf of claim 1, wherein the pocket and keyhole form a keyhole-pocket assembly, with the scarf including more than one keyhole-pocket assembly.

* * * * *